US008516994B2

(12) United States Patent
Gregoire

(10) Patent No.: US 8,516,994 B2
(45) Date of Patent: Aug. 27, 2013

(54) FUEL INJECTION SYSTEM

(75) Inventor: Jim Gregoire, Marysville, WA (US)

(73) Assignee: Turn and Bank Holdings, Inc., Gibsonville, NC (US)

( * ) Notice: Subject to any disclaimer, the term of this patent is extended or adjusted under 35 U.S.C. 154(b) by 725 days.

(21) Appl. No.: 12/777,967

(22) Filed: May 11, 2010

(65) Prior Publication Data

US 2011/0277730 A1 Nov. 17, 2011

(51) Int. Cl.
*F02M 69/22* (2006.01)
*F02M 59/46* (2006.01)

(52) U.S. Cl.
USPC ..... 123/454; 123/467

(58) Field of Classification Search
USPC ..... 123/445, 452, 454, 456, 467, 457, 123/459, 460, 462, 463, 472
See application file for complete search history.

(56) References Cited

U.S. PATENT DOCUMENTS 2,913,231 A * 11/1959 Powell et al. ..... 261/23.2
3,114,359 A * 12/1963 Haase ..... 123/450
5,845,621 A * 12/1998 Robinson et al. ..... 123/456
5,896,843 A * 4/1999 Lorraine ..... 123/467
6,314,942 B1 * 11/2001 Kilgore et al. ..... 123/467
6,371,083 B1 * 4/2002 Rossi et al. ..... 123/456
6,631,705 B1 * 10/2003 Rivera ..... 123/454
6,672,286 B2 * 1/2004 Miandoab et al. ..... 123/456
6,736,111 B2 * 5/2004 Braun et al. ..... 123/456
2011/0197854 A1 * 8/2011 Hall ..... 123/445

* cited by examiner

*Primary Examiner* — Thomas Moulis
(74) *Attorney, Agent, or Firm* — Lane Powell PC; Priya Sinha Cloutier

(57) ABSTRACT

A fuel injection system is described, and which has an upstream portion and a downstream portion. The upstream portion includes a source of fuel, the fuel inlet of a fuel injection servo or flow regulator, and a first fuel flow line connected in fuel flowing relation relative to the source of fuel and to the fuel inlet of the fuel injection servo. The downstream portion includes a flow divider, at least one fuel outlet of the fuel injection servo, and a second fuel flow line connected in fuel flowing relation relative to the flow divider and the fuel outlet of the fuel injection servo. A fuel accumulator pressure damper is mounted in fuel flowing relation relative to the downstream portion of the fuel injection system so as to substantially reduce standing waves in the fuel injection system.

14 Claims, 7 Drawing Sheets

FUEL INJECTION SYSTEM

TECHNICAL FIELD

The present invention relates to a fuel injection system, and more specifically to a fuel injection system for an aircraft engine and that comprises a fuel accumulator or pressure damper that substantially reduces standing waves within the fuel injection system.

BACKGROUND OF THE INVENTION

While fuel injection systems have all but entirely replaced carburetors in automotive engines, the transition from traditional carburetors to fuel injectors in aircraft engines has been slower. Nonetheless, fuel injection systems have become very popular for aircraft engines because they provide greater performance, economy, and reliability.

Most prior art fuel injection systems used in aircraft engines are volume-air flow type systems, which are based on the principle of measuring air flow to establish correct fuel flow to the engine cylinders. These systems include a throttle body fuel injection servo which measures the amount of air moving past the throttle by use of a venturi. An in-line diaphragm type flow regulator then converts the air pressure from the venturi into a proportional fuel pressure. During normal operation of the aircraft engine, the position of the throttle controls the air flow through the fuel injection servo or to the regulator, which then controls the flow of fuel to the cylinders. The servo is the primary component used in the fuel injection system and performs all functions required to establish fuel flow volumes. The regulated fuel flow from the servo is sent to a fuel flow divider, which divides the steady stream of fuel into smaller streams of fuel, one for each cylinder. Fuel lines carry fuel from the divider to injector nozzles located in the intake ports of each cylinder. The injectors supply fuel to the intake manifold. Fuel then enters the cylinder from the intake manifold under the low pressure created in the cylinder during the intake cycle.

During normal operation of the aircraft engine, the position of the throttle and the air flowing through the fuel injection servo or flow regulator, controls the flow of fuel to the cylinders. As the throttle is opened, more fuel is delivered to each cylinder, resulting in an increase in the speed of the engine or in manifold pressure, and thus more power being generated by the engine. In certain circumstances, due to mechanisms that cannot be adequately modeled, operators of some fuel-injected aircraft engines have discovered that switching on the auxiliary or boost fuel pump when the aircraft is on the ground and the engine is set to idle or at a low power setting has caused a slight change in RPM and fuel flow reading fluctuations.

A fuel injection system which avoids the shortcomings attendant with the prior art devices and practices utilized heretofore is the subject matter of the present application.

SUMMARY OF THE INVENTION

A first aspect of the present invention relates to a fuel injection system which includes a fuel injection servo with a fuel inlet and first and second fuel outlets, and wherein the fuel inlet is in fuel flowing relation relative to a source of fuel, and wherein the first fuel outlet is in fuel flowing relation relative to a fuel flow divider, and wherein the second fuel outlet is in fuel flowing relation relative to a fuel accumulator.

A second aspect of the present invention relates to a fuel injection system, which includes a fuel injection servo with a fuel inlet and at least one fuel outlet; an upstream portion of the fuel injection system, comprising a source of fuel, the fuel inlet of the fuel injection servo, and a first fuel flow line connected in fuel flowing relation relative to the source of fuel and to the fuel inlet of the fuel injection servo; a downstream portion of the fuel injection system, comprising a flow divider, at least one fuel outlet of the fuel injection servo, and a second fuel flow line connected in fuel flowing relation relative to the flow divider and at least one fuel outlet of the fuel injection servo; and a fuel accumulator mounted in fuel flowing relation relative to the downstream portion of the fuel injection system.

A third aspect of the present invention relates to a fuel injection system for an aircraft engine, which includes a source of fuel; a fuel injection servo with a fuel inlet, and wherein the source of fuel is connected in fuel supplying relation relative to the fuel inlet of the fuel injection servo; and a fuel accumulator mounted downstream of the fuel inlet of the fuel injection servo, and wherein the fuel accumulator comprises a vessel fabricated from a pressure compliant material which substantially reduces standing waves in the fuel injection system.

A fourth aspect of the present invention relates to a fuel injection system which includes a source of fuel; a first fuel flow line connected in fuel flowing relation relative to the source of fuel; a fuel injection servo with a fuel inlet which is in fuel receiving relation relative to the first flow line, and wherein the fuel injection servo has a first and a second fuel outlet; a second fuel flow line connected in fuel flowing relation relative to the first fuel outlet of the fuel injection servo; a flow divider which is in fuel receiving relation relative to the second fuel flow line; a plurality of third fuel flow lines which is in fuel receiving relation relative to the flow divider; a plurality of fuel injector nozzles which are in fuel receiving relation relative to the respective plurality of third fuel flow lines; and a fuel accumulator mounted in fuel flowing relation relative to the second fuel outlet of the fuel injection servo, and wherein the accumulator comprises a vessel fabricated from a pressure compliant material which substantially reduces standing waves in the fuel flowing within the first fuel flow line, the fuel injection servo, the second fuel flow line, the flow divider and/or any of the plurality of third fuel flow lines. These and other aspects of the present invention will be described in greater detail hereinafter.

BRIEF DESCRIPTION OF THE DRAWINGS

Other features and advantages of the present invention will become apparent in the following detailed descriptions of the preferred embodiment with reference to the accompanying drawings, of which:

FIG. 3*a* is a side elevation view of a second fuel injection servo, including the fuel accumulator, and which is subject of the present invention;

FIG. 4 is a schematic representation of a second form of the fuel injection system which is an alternate form of the present invention.

FIG. 5 is an exploded view of the fuel accumulator, which is a component of the subject invention.

FIG. 6 is an exploded view of the fuel accumulator, which is a component of the subject invention.

DETAILED DESCRIPTION OF THE PREFERRED EMBODIMENTS

In the description of the invention above and in the detailed description of the invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. Referring now in detail to the FIGS. 1 though 6, wherein the same numbers are used where applicable, a fuel control system constructed in accordance with an embodiment of the invention is identified generally as the reference number 10. Although the description below anticipates the fuel injection system 10 will be used on aircraft, it will be obvious to those skilled in the art that the fuel injection system 10 can be used on any type of combustion engine.

Figure 1:
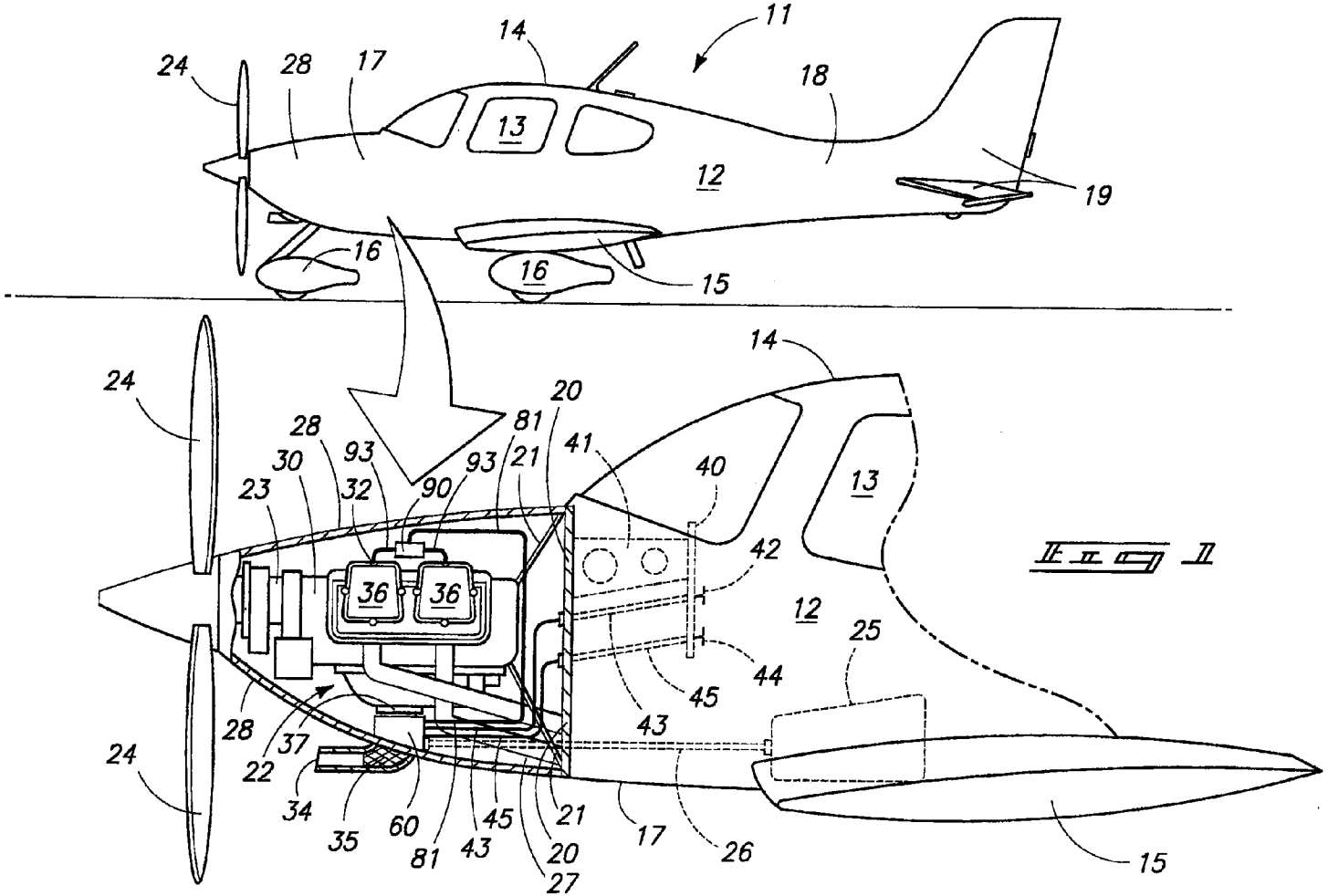
FIG. 1 is a fragmentary, side elevation view of an airplane, upon which the present invention is applied.

Referring first to FIG. 1, an aircraft 11 is shown, within which the subject invention, a fuel injection system generally indicated by the numeral 10 is installed. The aircraft 11, as shown in FIG. 1, is a single engine, low-wing, all-metal or composite airplane powered by an internal combustion piston engine of conventional design. While the subject invention 10 is normally applied to an aircraft platform, it should be recognized that the invention 10 may be applied to any motor vehicle in which an internal combustion engine is provided for motive power, including but not limited to aircraft, automobiles, trucks, boats, recreational vehicles, off-road vehicles, and the like. Moreover, the subject invention may be applied to any form of aircraft in which an internal combustion piston engine is used for motive power, including helicopters, unmanned aircraft, blimps, multi-engine aircraft, light-sport aircraft, ultralights, etc. An application on a single-engine airplane is provided and described throughout this description only for exemplary purposes and to describe the best mode of the invention.

The aircraft 11, as shown in FIG. 1, includes a fuselage 12, which in turn, includes a cockpit 13, covered by a canopy 14, and which houses the aircraft operator or pilot (not shown). The aircraft 11 includes a wing 15, which is supported when the aircraft is on the ground by the landing gear 16. The fuselage 12 has a first end 17 and an opposite second end 18, at which the empennage 19 is mounted. The first end 17 of the fuselage 12 is defined by a firewall 20, which is a substantially vertically mounted bulkhead designed to isolate and protect the cockpit 13 from the engine bay 27, as defined below. An engine mount 21, usually fabricated from tubular steel, is mounted upon the firewall 20, and the engine 22 is then mounted upon the engine mount 21. The engine 22 as described herein and as shown in the drawings is typically a four cylinder, horizontally opposed, air-cooled, gasoline fueled, fuel injected, normally aspirated internal combustion piston engine of conventional design for aircraft applications. A typical engine part number is a TEXTRON-LYCOMING IO-360-A1A. One skilled in the art will recognize that the subject invention can be applied to any number of variants of this engine design, including those with other than four cylinders, turbocharged, water-cooled, diesel powered, or those based on automotive engine designs (so-called "auto-derivatives"). As discussed above, the fuel injection system 10 of the subject invention can be applied to any internal combustion engine, on any vehicular platform, in which fuel injection systems are normally employed.

Referring still to FIG. 1, the engine 22 comprises a drive shaft 23, which is directly coupled to the propeller 24, and which provides tractor motive force to the aircraft 11. The engine resides within the engine bay 27, which is defined by the engine cowl 28. The engine 22 is fueled by aviation gasoline ("avgas") stored in fuel tanks 25 fitted into the wings 15. One skilled in the art will recognize that the fuel tanks may also store automotive gasoline ("mogas"), ethanol, bio-fuel, or any other applicable fuel that is compatible with the engine.

A first fuel line 26 carries fuel from the fuel tank 25, through the firewall 20, to the fuel injection servo or flow regulator 60, which is part of the fuel injection system 10 which will be fully described below. The engine 22 comprises an engine block or crank case 30, in which multiple cylinders (not shown) are mounted behind valve covers 36. The fuel injection servo is mounted to the engine block 30 with a servo mount 37. The individual components and details of conventional engine design need not be provided here, other than to note that each cylinder has a cylinder fuel intake 32, which is connected in fuel receiving relation relative to the fuel injection servo 60 by way of a second fuel line 81, a fuel divider 90, and third fuel lines 93, as described fully below. Also, the engine cowl 28 defines an air intake 34, which provides input air to the fuel injection servo 60 through an air filter 35.

The engine 22 is controlled from the cockpit 13 primarily through the throttle control 42 and the mixture control 44, both of which are mounted on the control panel 40 within the cockpit 13. The control panel 40 is mounted on the firewall 20 with a control panel mounting bracket 41. The control panel 40 will also be used to mount various engine instruments, not shown, which will provide the pilot information on the operation of the engine 22. The throttle control 42 is mechanically linked to a throttle control cable 43, and the mixture control 44 is mechanically linked to a mixture control cable 45, both of which are in turn mechanically linked to the fuel injection system 10, as fully described below. From an operational standpoint, the throttle 42 controls the power output of the engine, and the mixture 44 controls the mix of air and fuel (and thus whether the engine runs "lean" or "rich"). It should be recognized that the present invention 10 may also be applied in systems with electronic throttle and mixture controls, such as those used in a FADEC ("full authority digital engine control") system, and the like.

Figure 2:
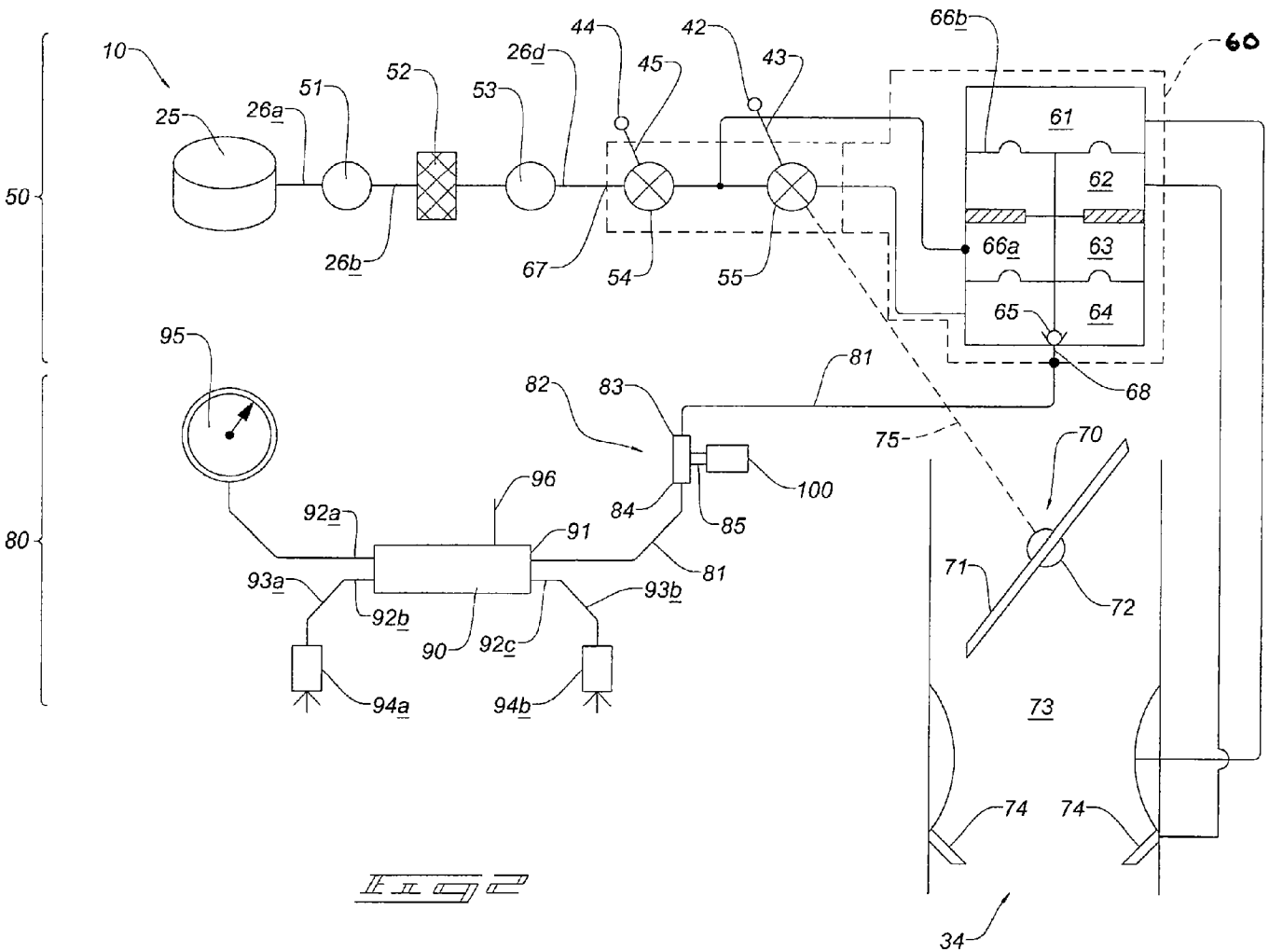
FIG. 2 is a schematic representation of one form of the fuel injection system which is the subject of the present invention.

Referring now to FIG. 2, a schematic diagram of the fuel injection system 10, which is the subject of the present invention, is shown. As discussed above, fuel is stored in fuel tank or source of fuel 25, normally mounted within the wing 15. A first fuel flow line 26 carries fuel from the fuel tank 25 to an auxiliary pump 51. One skilled in the art will recognize that many variants on the design of the overall fuel system exist and are compatible with the present invention, including that for a high-wing airplane, which may not have an auxiliary fuel pump 51.

The description provided herein applies to a typical low-wing aircraft and is provided only for exemplary and best mode purposes. The first fuel flow line 26 then carries fuel from the auxiliary pump 51 to a fuel filter 52 and then to an engine driven fuel pump 53, which pumps fuel from the fuel tank 25 to the engine 22 during normal aircraft operation. The first fuel line 26 then carries fuel from the engine driven pump 53 to a mixture control valve 54, which is mechanically linked to the mixture control 44 by the mixture control cable 45.

Some of the fuel from the mixture control valve 54, depending on the setting of the mixture control 44 by the pilot, will flow to the unmetered fuel chamber 63 of the fuel injection servo or flow regulator 60, which acts upon the diaphragm 66 to close the ball valve 65.

Fuel for powering the engine 22 then flows from the mixture control valve 54 to the throttle valve 55, which is mechanically linked to the throttle control 42 by the throttle control cable 43. Fuel then flows between the engine driven fuel pump 53 and mixture control valve 54 into the metered fuel chamber 64, and acts upon the diaphragm 66 to open the ball valve 65. The ball valve 65 controls the flow of fuel and pressure at the first fuel outlet 68 of the fuel injection servo 60. The fuel injection servo 60 may also include a second or auxiliary outlet 69, which will be discussed below.

While the present invention may apply to any type of fuel injection system for an internal combustion engine, the fuel injection system as shown in the drawings is an air flow type system, which is based on the principle of measuring air flow to establish correct fuel flow to the engine cylinders. In this system, the fuel injection servo or flow regulator 60 measures the amount of air moving past the throttle by use of a venturi. Referring still to FIG. 2, the throttle control 42 is mechanically linked to the throttle air valve 70 by way of a throttle linkage 75. The throttle air valve 70 comprises a throttle vane 71 which rotates about a throttle pivot 72, depending on the throttle control position selected by the pilot.

Air enters the throttle body injection servo 60 through the air intake 34 (normally through an air filter 35, shown on FIG. 1). Air passes over impact tubes 74 and a venturi 73, as controlled by the position of the vanes 71 of the throttle air valve 70. The impact tubes 74 are in pressure communicating relation relative to the impact air chamber 62, and the venturi is in pressure communicating relation relative to the venturi air chamber 61, both within the fuel injection servo or flow regulator 60.

The pressure created within the impact air chamber 62 and the venturi chamber 61 act upon the diaphragm 66*b*, which controls the position of the ball valve 65. The inlet 67 pressure is held relatively constant by the engine driven fuel pump 53, and the outlet 68 pressure is controlled by the balance between the metered 64 and unmetered 63 fuel and air metering forces as applied in the chambers 61 and 62 to the diaphragms 66. When the throttle vane 71 is opened, the air metering force increases, resulting in this balance of forces to cause the ball valve 65 to open and set a stabilized fuel flow to the engine cylinders, as discussed below.

Referring still to FIG. 2, the portion of the fuel injection system from the fuel tank or source of fuel 25 to the fuel inlet 67 of the fuel injection servo 60 is defined herein as the upstream portion 50 of the fuel injection system. It is also recognized that the fuel inlet 67 is in fuel flowing relation relative to the source of fuel 25, as described in detail above. The portion from the fuel outlet 68 of the fuel injection servo 60 to the injector nozzles 94, as will be discussed in detail below, is defined herein as the downstream portion 80 of the fuel injection system. From the fuel outlet 68 of the fuel injection servo 60, a second fuel flow line 81 carries fuel to the flow divider 90. Therefore, the fuel outlet 68 is in fuel flowing relation relative to the flow divider 90. The flow divider 90 has a first input 91, fuel port 96, and a plurality of outputs 92. One of the outputs 92 is connected to a fuel pressure meter 95, which is mounted on the control panel 40. The remaining outputs 92 carry fuel from the flow divider 90 to a respective plurality of third fuel flow lines 93, which are in turn each in fuel flowing relation relative to a respective plurality of injector nozzles 94. There is at least one injector nozzle 94 for each cylinder of the engine 22. These injector nozzles 94 then provide fuel to the engine as discussed above.

Referring to FIG. 5, a first preferred embodiment of a fuel accumulator assembly 100 is shown. The fuel accumulator assembly 100 comprises a vessel 102 which is received coaxially within a containment housing 108 and secured in place with a retainer 101. The retainer 101 presses the vessel 102 against the containment housing 108 thereby securing the vessel 102 into place and sealing the vessel 102 against fuel leaks.

Referring to FIG. 6, a second preferred embodiment, the fuel accumulator assembly 100*a* comprises a containment housing 108, a vessel 102, and retainers 101, 103. The vessel 102 is received coaxially into the containment housing 108. As above, the retainers 101,103 press the vessel 102 against the containment housing 108 securing the vessel into place and sealing the vessel 102 against fuel leaks.

The vessel 102 material is selected so that it will expand and contract in response to very short term increases and decreases in fuel pressure. For example, when a driving pressure wave is present that may form into a standing wave within a fuel flow line. Preferably, the vessel 102 is fabricated from florosilicone or other similar material having a durometer of between 35-65 Shore A. However, it will be obvious to a person having ordinary skill in the art that any material having similar properties can be used for the vessel 102.

Figure 3:
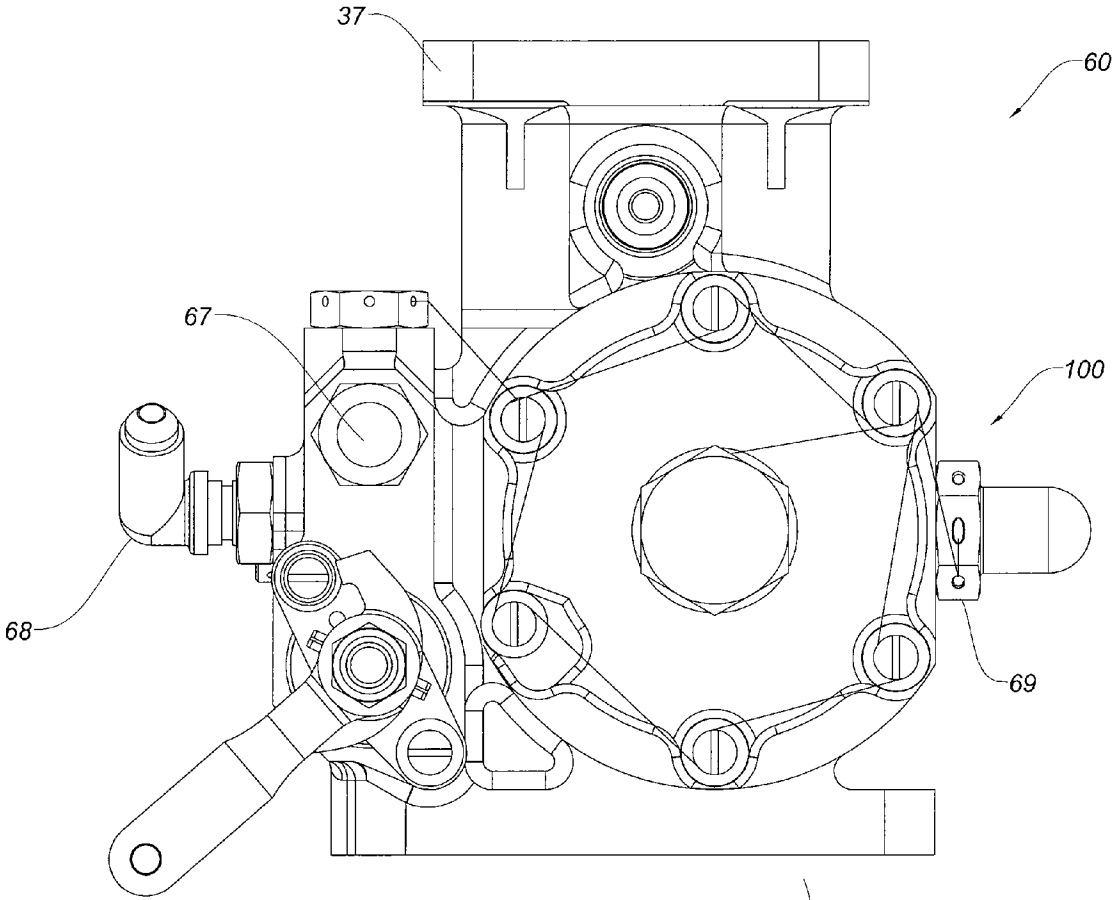
FIG. 3 is a side elevation view of a fuel injection servo, including the fuel accumulator, and which is the subject of the present invention.
Figure 11:
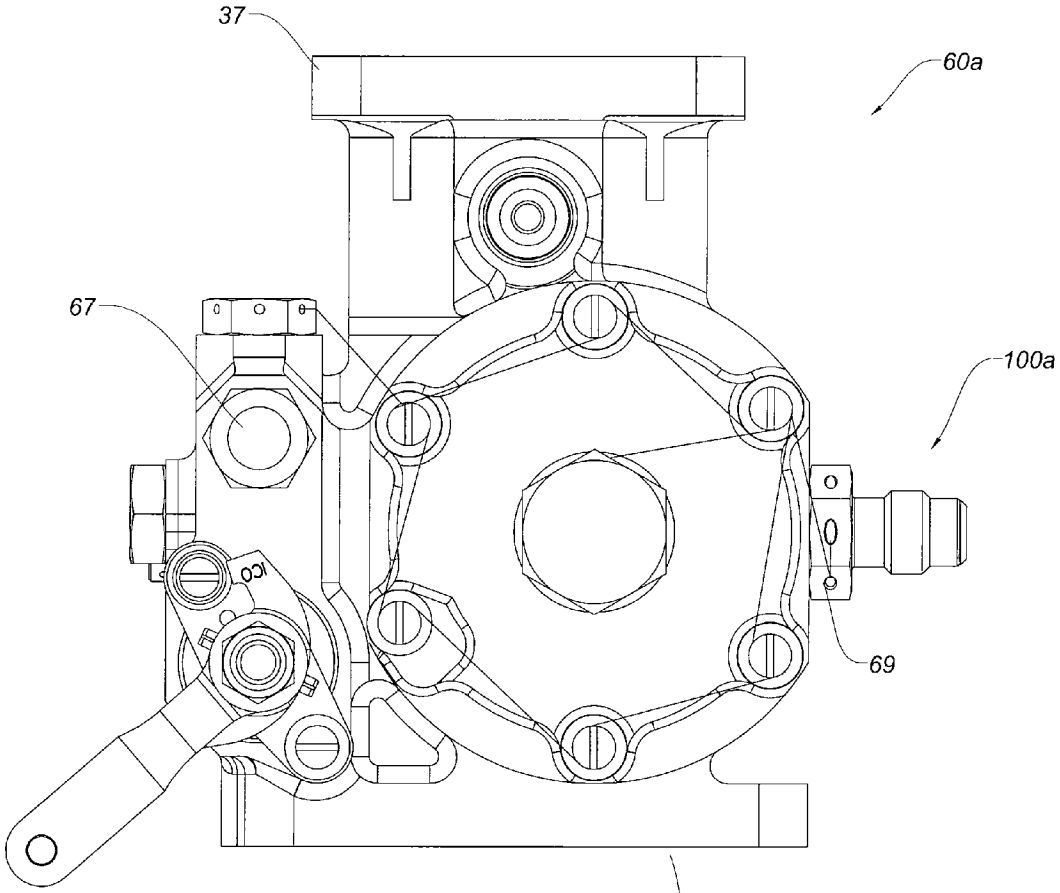
Figure 11:
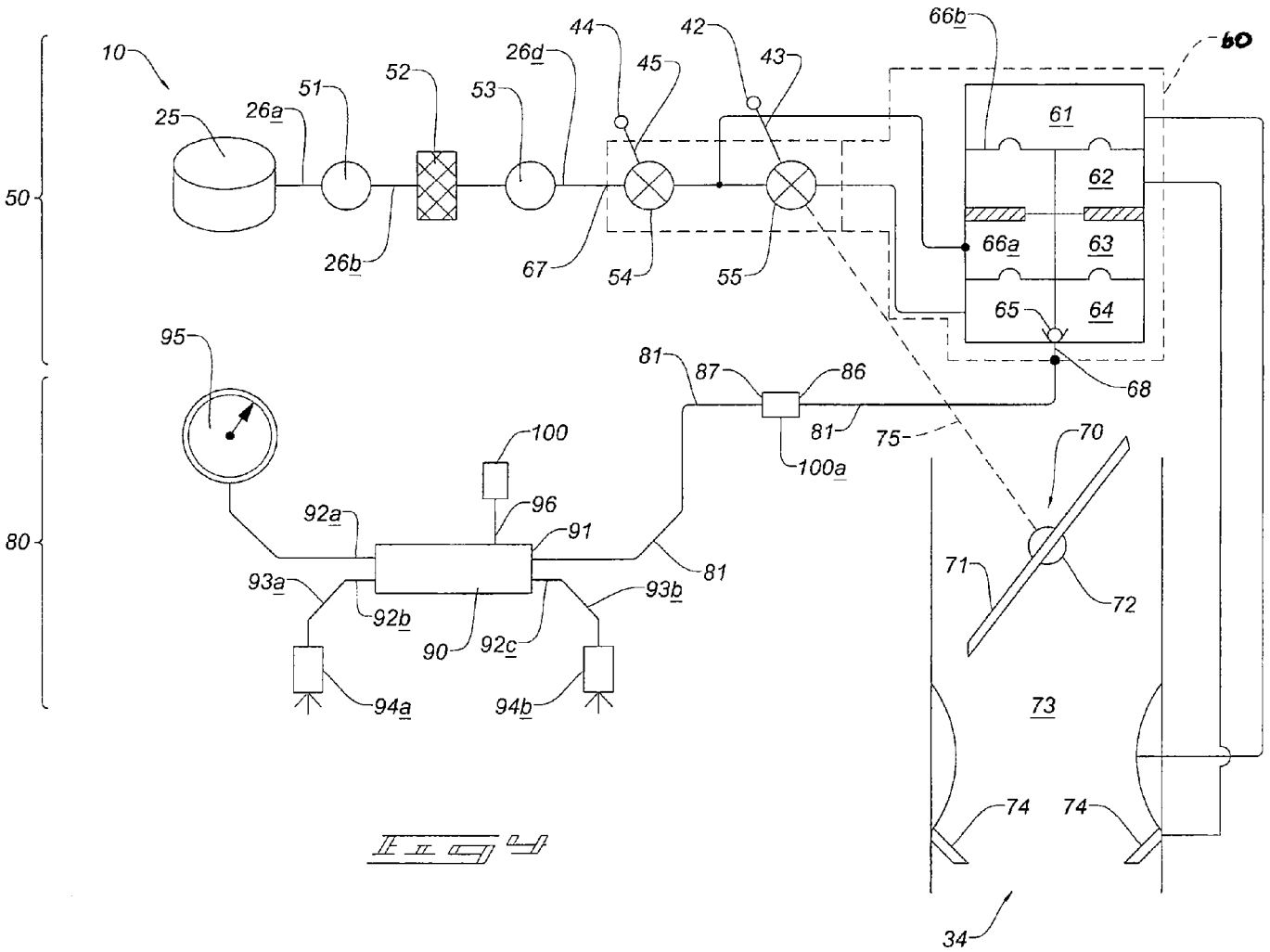
Figure 11:
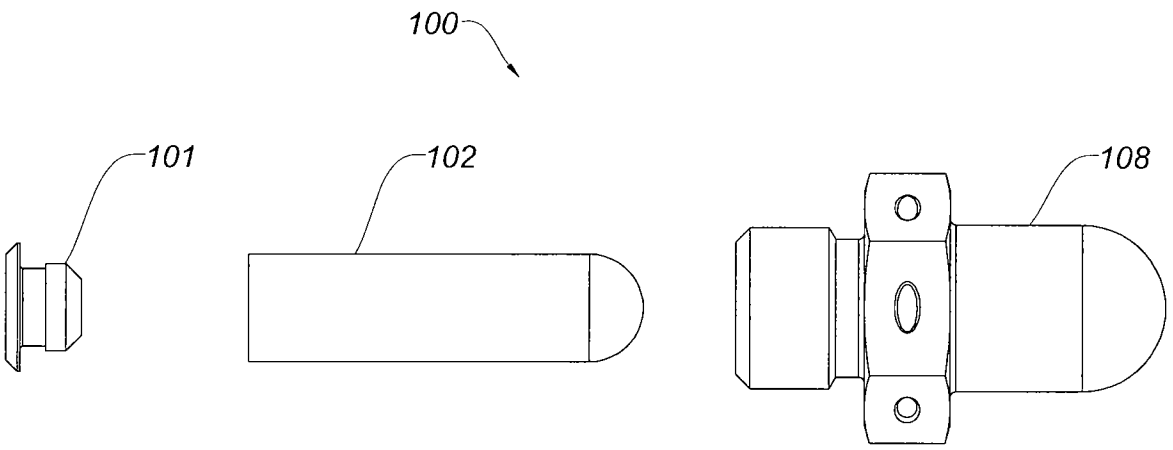
Figure 11:
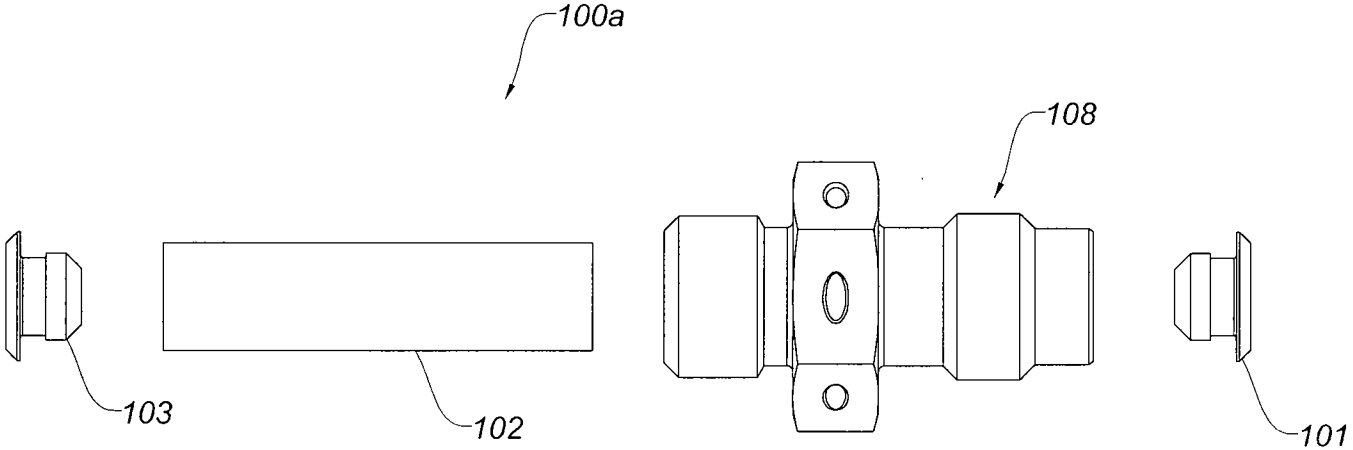

FIG. 3 is a side elevation view of the fuel injection servo 60 is provided. The fuel injection servo 60 has two fuel outlets, a first or primary fuel outlet 68 and a second or auxiliary fuel outlet 69. FIG. 3*a* is a side elevation view of the a second fuel injection servo 60*a*. The fuel injection servo 60*a* has one fuel outlet 69.

In a first embodiment of the fuel injection system 10, the fuel accumulator 100 is mounted to the second fuel outlet 69 in a dead-ended configuration. When so mounted, the second fuel outlet 69 is in fuel flowing relation relative to the fuel accumulator 100.

Here, the fuel accumulator 100 serves to dampen and substantially reduce any standing waves in the fuel flowing in any part of the fuel injection system 10 including but not limited to, the first fuel flow line 26, the fuel injection servo 60, the second fuel flow line 81, the flow divider 90 and/or any of the plurality of third fuel flow lines 93.

In a second embodiment of the fuel injection system 10, the fuel accumulator 100 is mounted. As shown in FIG. 2, a T-fitting 82, with a first end 83, second end 84, and third end 85, is installed in the second fuel flow line 81. The first end 83 of the T-fitting 82 is installed in fuel flowing relation relative to the upstream end of the second fuel flow line 81 or to the first fuel outlet 68 of the fuel injection servo 60; the second end 84 of the T-fitting 82 is installed in fuel flowing relation relative to the downstream end of the second fuel flow line 81 or to the flow divider 90; and the third end 85 of the T-fitting 82 is installed in fuel flowing relation relative to the fuel accumulator 100, using the single threaded fitting in a dead-ended configuration.

In a third preferred embodiment of the fuel injection system 10, shown in FIG. 4, the fuel accumulator 100 is mounted in serial fuel flowing relation relative to the second fuel flow line 81, so that fuel flows through the fuel accumulator 100*a*. As shown in FIG. 4, a first end 86 of the accumulator 100 is installed in fuel flowing relation relative to the upstream end of the second fuel flow line 81 or to the first fuel outlet 68 of the fuel injection servo 60; the second end 87 of the serial accumulator 100*a* is installed in fuel flowing relation relative to the downstream end of the second fuel flow line 81 or to the flow divider 90.

In a fourth preferred embodiment of the fuel injection system 10, as shown in FIG. 4, the fuel accumulator 100 is shown installed in fuel flowing relation relative to the auxiliary fuel port 96 of the flow divider 90 or within the flow divider 90 itself.

Referring to FIG. 3*a*, in a fifth embodiment of the fuel injection system 10, the fuel accumulator 100*a* is mounted to the fuel outlet 69 in a flow-through configuration. When so mounted, the fuel outlet 69 is in fuel flowing relation relative to the fuel accumulator 100*a*.

Here, the fuel accumulator 100*a* serves to dampen and substantially reduce any standing waves in the fuel flowing in any part of the fuel injection system 10 including but not limited to, the first fuel flow line 26, the fuel injection servo 60*a*, the second fuel flow line 81, the flow divider 90 and/or any of the plurality of third fuel flow lines 93.

One skilled in the art will recognize that for all forms of the invention, the fuel accumulator 100 or 100*a* is installed in fuel flowing relation relative to the downstream portion 80 of the fuel injection system.

What is claimed is:

1. A fuel injection system, comprising:

a fuel injection servo with a fuel inlet and at least one fuel outlet;

an upstream portion of the fuel injection system, comprising a source of fuel; the fuel inlet of the fuel injection servo; and a first fuel flow line connected in fuel flowing relation relative to the source of fuel and to the fuel inlet of the fuel injection servo;

a downstream portion of the fuel injection system, comprising a flow divider;

at least one fuel outlet of the fuel injection servo; and a second fuel flow line connected in fuel flowing relation relative to the flow divider and the at least one fuel outlet of the fuel injection servo; and a fuel accumulator mounted in fuel flowing relation relative to the downstream portion of the fuel injection system; wherein the fuel accumulator comprises a vessel fabricated from a pressure compliant material received within containment housing.

2. A fuel injection system as claimed in claim 1, and wherein the fuel accumulator vessel is a tube.

3. A fuel injection system as claimed in claim 1, and wherein the fuel accumulator is mounted in serial fuel flowing relation relative to the second fuel flow line.

4. A fuel injection system as claimed in claim 1, and wherein the second fuel flow line further comprises a T-fitting with a first end connected in fuel flowing relation relative to the first fuel outlet of the fuel injection servo, and a second end connected in fuel flowing relation relative to the flow divider, and a third end connected in fuel flowing relation relative to the fuel accumulator.

5. A fuel injection system as claimed in claim 1, and wherein the fuel injection servo has a second fuel line, and wherein the fuel accumulator is connected in fuel flowing relation relative to the second fuel line of the fuel injection servo.

6. A fuel injection system as claimed in claim 1, and wherein the flow divider comprises an auxiliary fuel port, and wherein the fuel accumulator is connected in fuel flowing relation relative to the auxiliary fuel port of the flow divider.

7. A fuel injection system as claimed in claim 1, and wherein the fuel accumulator substantially reduces standing waves in the downstream portion of the fuel injection system.

8. A fuel injection system for an aircraft engine, comprising:

a source of fuel;

a fuel injection servo with a fuel inlet, and wherein the source of fuel is connected in fuel supplying relation relative to the fuel inlet of the fuel injection servo; and a fuel accumulator mounted downstream of the fuel inlet of the fuel injection servo, and wherein the fuel accumulator comprises a vessel fabricated from a pressure compliant material which substantially reduces standing waves in the fuel injection system.

9. A fuel injection system as claimed in claim 8, and wherein the fuel injection servo has a fuel outlet, and wherein a fuel flow line connects the fuel outlet of the fuel injection servo in fuel supplying relation relative to a flow divider.

10. A fuel injection system as claimed in claim 9, and wherein the fuel accumulator is mounted in serial fuel flowing relation relative to the fuel flow line.

11. A fuel injection system as claimed in claim 9, and wherein the fuel flow line further comprises a T-fitting with a first end connected in fuel receiving relation relative to the fuel outlet of the fuel injection servo, and a second end connected in fuel supplying relation relative to the flow divider, and a third end connected in fuel flowing relation relative to the fuel accumulator.

12. A fuel injection system as claimed in claim 9, and wherein the flow divider comprises an auxiliary fuel port, and wherein the fuel accumulator is connected in fuel flowing relation relative to the auxiliary fuel port of the flow divider.

13. A fuel injection system as claimed in claim 9, and wherein the fuel injection servo has a first and a second fuel outlet, and wherein the fuel accumulator is connected in fuel flowing relation relative to the second fuel outlet of the fuel injection servo.

14. A fuel injection system as claimed in claim 9, and wherein the fuel accumulator is mounted to the second fuel outlet of the fuel injection servo with a single threaded fitting.

* * * * *